US007044518B2

(12) United States Patent
Lang et al.

(10) Patent No.: US 7,044,518 B2
(45) Date of Patent: May 16, 2006

(54) COMBINATION PASTRY SUPPORT AND SERVER

(76) Inventors: Timothy James Lang, 108 Mornington St., Stratford, Ontario (CA) N5A 5G1; Laura Lorraine Lang, 108 Mornington St., Stratford, Ontario (CA) N5A 5G1

( * ) Notice: Subject to any disclaimer, the term of this patent is extended or adjusted under 35 U.S.C. 154(b) by 0 days.

(21) Appl. No.: 10/725,794

(22) Filed: Dec. 2, 2003

(65) Prior Publication Data

US 2005/0116483 A1 Jun. 2, 2005

(51) Int. Cl.
*A47J 43/28* (2006.01)

(52) U.S. Cl. ..... 294/7; 30/114; 30/124

(58) Field of Classification Search ..... 294/7, 294/15, 2, 32; 30/114, 140, 124; 15/236.05, 15/236.02; 7/113, 148; D7/543, 693, 610
See application file for complete search history.

(56) References Cited

U.S. PATENT DOCUMENTS

| | | | | |
|---|---|---|---|---|
| 1,612,367 | A * | 12/1926 | Fulton | 294/7 |
| 2,502,982 | A | 4/1950 | Norman | |
| 2,573,577 | A | 10/1951 | Koponen | |
| 2,598,789 | A * | 6/1952 | Harrell | 99/645 |
| 3,877,143 | A * | 4/1975 | Montesi | 30/114 |
| 4,114,265 | A | 9/1978 | Bailey | |
| 4,359,159 | A * | 11/1982 | Pollard | 206/551 |
| 4,637,138 | A * | 1/1987 | Piche | 30/114 |
| 4,877,609 | A | 10/1989 | Beck | |
| 4,969,268 | A * | 11/1990 | Kelly, III | 30/322 |

FOREIGN PATENT DOCUMENTS

| | | |
|---|---|---|
| CA | 327683 | 2/1932 |
| DE | 297 23 815 U1 | 4/1999 |
| DE | 202 17 100 U1 | 1/2003 |
| DE | 203 14 098 U1 | 12/2003 |
| DE | 203 17 359 U1 | 4/2004 |
| EP | 0 175 951 B1 | 10/1988 |

* cited by examiner

*Primary Examiner*—Eileen D. Lillis
*Assistant Examiner*—Esther Onyinyechi Okezie
(74) *Attorney, Agent, or Firm*—Howson & Howson

(57) ABSTRACT

A combination pastry support and server is provided by a formed polycarbonate sheet having a rectangular intermediate portion, and integral, trapezoidal flanges extending at an angle of 88° in opposite directions from its respective upper and lower edges. The trapezoidal flanges are tapered in opposite directions, making it possible to use the combination support and server on either exposed face of a partially cut circular cake.

16 Claims, 2 Drawing Sheets

COMBINATION PASTRY SUPPORT AND SERVER

FIELD OF THE INVENTION

This invention relates to improvements in devices for protection and service of cakes, pies and similar food products.

BACKGROUND OF THE INVENTION

In restaurants, cakes and pies are frequently displayed on plates or stands covered by a clear dome of glass or plastic. When a portion is needed for service to a customer, the dome is removed, a wedge-shaped portion is separated from the remainder of the cake or pie, and transferred to a plate by means of a cake server, which typically comprises a flat, wedge-shaped blade attached to a handle. Examples of such servers are depicted in U.S. Pat. No. 1,948,592, dated Feb. 27, 1934, and U.S. Pat. No. 4,877,609, dated Oct. 31, 1989. In some cases a cake or pie is pre-sliced into portions of predetermined size, and remains on display in its pre-sliced condition so that the portions can be readily removed using the server alone, without a separate cutting step. In other cases, the portion to be served is cut from the remainder of the cake or pie by means of a knife, or by using the server itself as a cutting blade.

Especially in the case in which the cake or pie is pre-sliced, movement of the plate or stand can cause one or more of the pre-sliced portions to shift, fall over, or lose form. Moreover, in the case of a particularly delicate cake, or a pie having a filling with a high liquid content, a sliced portion, or even an exposed end of the remainder, can collapse on its own, even without movement of the plate or stand on which the pastry is displayed.

Damage due to falling over, loss of form, or collapse of an article of pastry results in waste, especially in a restaurant, since the damaged article cannot be served to a customer.

Another problem encountered in the display of cakes and pies is that the interior surfaces, exposed when a portion is removed, are subject to deterioration over time due to drying and exposure to the atmosphere.

Some establishments attempt to overcome the aforementioned problems by fashioning stops from cardboard, or by covering the exposed surfaces of the pastry article with wax paper. However, these measures are generally unsatisfactory and inconvenient, and are often abandoned because they become more of a problem than the unsupported cake or pie.

The problems of collapse and exposure have been addressed by specially designed devices described in U.S. patents. For example, U.S. Pat. No. 3,677,168 describes a protector consisting of two plates which are hinged together and fit against opposed, exposed surfaces of a pie, cake, and wheel of cheese, to prevent the surfaces from drying and becoming stale. U.S. Pat. No. 2,573,577 describes the use of a pair of cake lifters and preservers, each comprising a vertical plate, a horizontal foot member, and a tab-like handle. The plates are positioned against the respective exposed surfaces of the cake, and the foot members are slipped underneath the cake and used to lift portions of the cake for service.

BRIEF SUMMARY OF THE INVENTION

The general object of this invention is to provide a simpler, more versatile, more effective, and less expensive, combination pastry support and server.

The combination pastry support and server in accordance with the invention comprises a substantially rigid, formed, sheet, preferably of polycarbonate resin. The sheet has an intermediate portion, which is preferably rectangular. The intermediate portion is adapted to engage a major portion of the surface of one exposed end of a remainder sector of a circular article of pastry. The intermediate portion has first and second, parallel opposite edges. A first flange, which is unitary with the intermediate portion, extends transversely in a first direction from the first edge of the intermediate portion, and a second flange, also unitary with said intermediate portion, extends, from the second edge of the intermediate portion, in a second direction, opposite to the first direction. This structure allows the first and second flanges to be used interchangeably, respectively as a handle, and as a support for lifting a serving portion of the pastry article.

In the preferred embodiment, at least major portions of each of the first and second flanges have parallel, planar, opposite surfaces. The planar major portions of the surfaces of both of the first and second flanges are parallel. The rectangular intermediate portion also has parallel, planar, opposite surfaces, and the planar major portions of each of the flanges are disposed at an acute angle, preferably about 88 degrees, relative to the planar surfaces of the intermediate portion. The acute angular relationship between the flanges and the intermediate portion, improves the support of the pastry article.

The flanges are tapered in opposite directions, the longer ends of the respective flanges meeting the intermediate portion at diagonally opposite locations. This allows the combination support and server to be reversed for use with either of the exposed surface of the remainder segment of a circular pastry article. The principal advantage of this structure is that it obviates two different support/servers, as in U.S. Pat. No. 3,573,577.

Preferably, each of the flanges has an outer edge spaced from the rectangular intermediate portion and having a first end and a second end, the distance from the first end to the intermediate portion being greater than the distance from the second end to the intermediate portion. This structure has the advantage that it allows a part of the lower flange to extend past an already cut serving portion and underneath an adjacent part of the pastry article to afford better support, preventing the combination support and server, and the serving portion on it, from falling over. This structure also allows the combination support and server to be used with rectangular cakes and the like. Preferably, each of the flanges has a trapezoidal shape, and at least the outer edge of each flange is beveled to facilitate insertion underneath the pastry article. At least parts of the longer and shorter edges may also be beveled for the same reason.

Other objects, details and advantages of the invention will be apparent from the following detailed description when read in conjunction with the drawings.

DETAILED DESCRIPTION OF THE PREFERRED EMBODIMENT

Figure 1:
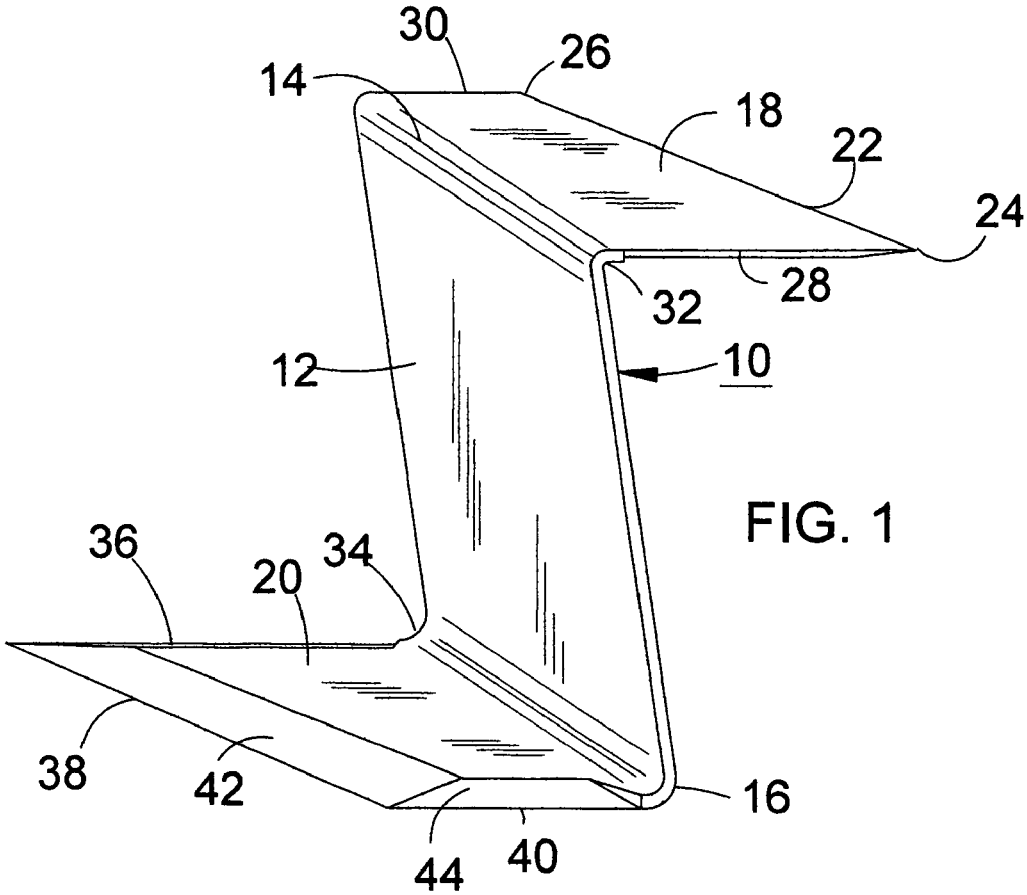
FIG. 1 is an oblique perspective view of a preferred embodiment of a combination pastry support and server in accordance with the invention.

As shown in FIG. 1, the combination pastry support and server 10 is a unitary, substantially rigid sheet of synthetic resin material formed into a shape generally resembling the letter "Z", with trapezoidal upper and lower flanges.

Figure 2:
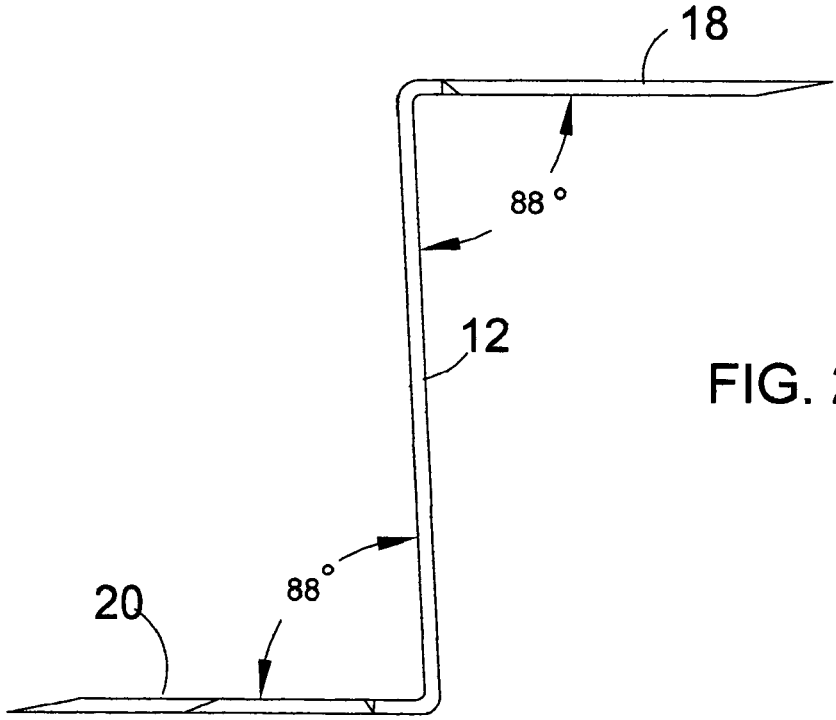
FIG. 2 is a side elevation thereof.

The intermediate portion 12 of the sheet is preferably planar, and rectangular in shape, and has parallel, opposite, first and second edges 14 and 16. A flange 18 extends transversely relative to the intermediate portion 12, in a first direction from edge 14, and a similar flange 20 extends from edge 16 in the opposite direction. As seen in FIG. 2, the flanges 18 and 20 are preferably parallel to each other. While they may be disposed in perpendicular relation to the intermediate portion 12, they preferably meet the intermediate portion at an acute angle. The acute angle, allows the intermediate portion to lean into the exposed surface of an article of pastry, thereby providing improved support, preventing the article of pastry from collapsing. It has been determined that an angle of 88 degrees results in optimum support.

The outer edge 22 of flange 18 is preferably straight, and disposed in oblique relationship to edge 14 of the intermediate portion 12, so that the distance between its first end 24 the intermediate portion is greater than the distance between its second end 26 and the intermediate portion. Thus, where the flange is trapezoidal, it has two base edges, 28 and 30, both meeting the first edge 14 of the intermediate portion, edge 28 being longer than edge 30.

The flanges 18 and 20 are preferably identical in shape, and tapered in opposite directions, as seen in FIG. 1. Thus, the longer edge 28 of the first flange 18 meets the intermediate portion 12 at a location 32 which is diagonally opposite the location 34 at which the longer edge 36 of the second flange 20 meets the intermediate portion 12.

FIG. 1 also shows that edges 36, 38 and 40 of flange 20 are beveled in such a way that the lower surface of the flange is entirely planar, while the planar part of the upper surface of the flange has an area smaller than that of the lower surface. The bevels at edges 38 and 40, are seen at 42 and 44. The upper flange 18 is similarly beveled.

Figure 3:
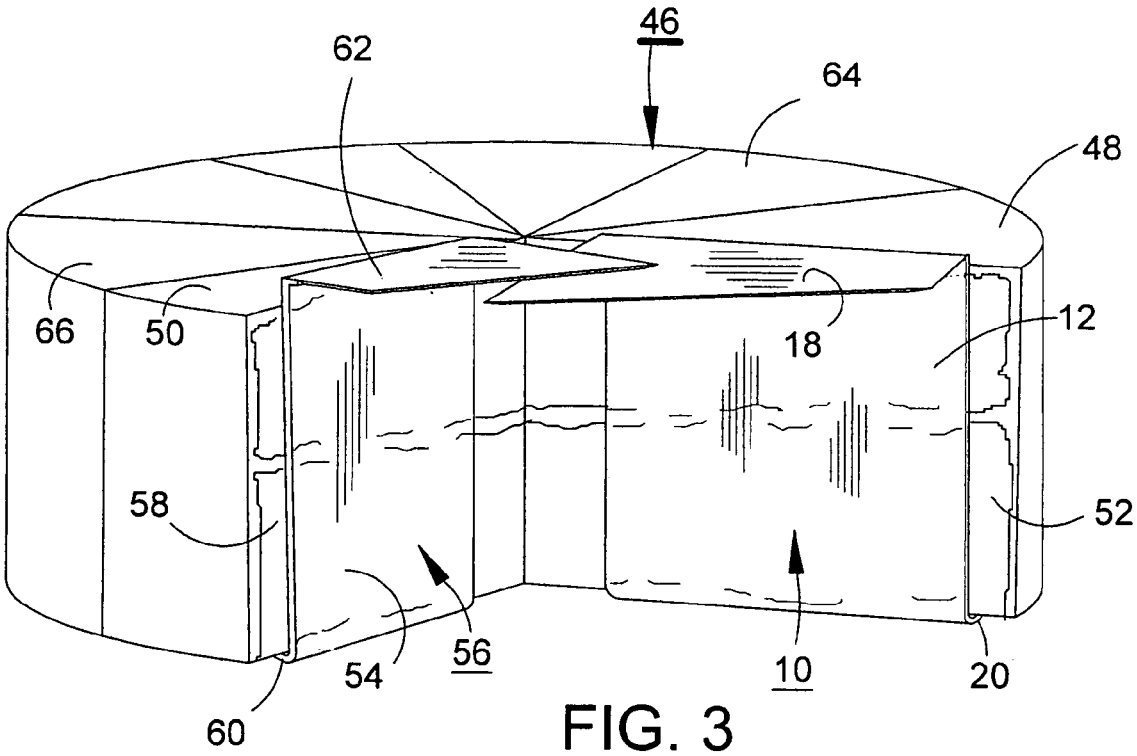
FIG. 3 is a perspective view showing two of the support/server combinations in use as supports on a cake.

FIG. 3 shows a portion of a cake 46 from which several slices have already been removed. What remains is in the form of a remainder sector which, in FIG. 3, subtends an angle somewhat greater than 180°. The cake has been pre-sliced into wedge-shaped servings, including end servings 48 and 50. The intermediate portion 12 of support/server 10 is engaged with the exposed face 52 of serving 48, its lower flange 20 having been slid underneath serving 48. As shown in FIG. 3, the intermediate portion 54 of a support/server 56, which is identical to support server 12, is engaged with exposed face 58 of serving 50, its lower flange 60 having been slid underneath serving 50. The beveled edges of the flanges facilitate sliding of the flanges underneath the pastry article.

The upper flanges 18 and 62 of the respective support/servers, which are used as handles, overlap each other, when the angle subtended by the remainder sector is significantly greater than 180°. However, the flexibility of the cake, and also the beveled edges of the flanges make it easy to position the two support/servers with their upper flanges in overlapping relationship.

Because of the trapezoidal shape of the lower flanges, parts (not shown in FIG. 3) of the lower flanges 20 and 60 extend past servings 48 and 50 respectively and underneath the next servings 64 and 66. The weight of these next servings, acting on the flanges, ensures that the support/servers and end servings 48 and 50, will not tip over, even when servings 64 and 66 are pre-sliced.

Figure 4:
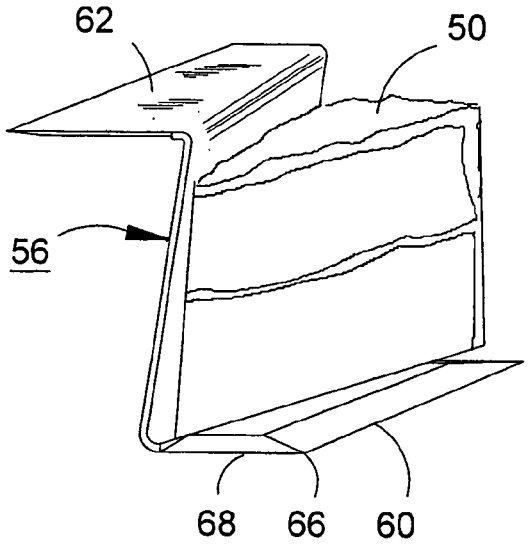
FIG. 4 is a perspective view showing one of the support/server combinations in use as a server.

FIG. 4 shows support/server 56 in use as a server to move serving 50, upper flange 62 being usable as a handle. As will be apparent from FIG. 4, at least the corner 66 of the shorter base edge 68 of the trapezoidal lower flange 60 extends well beyond serving 50.

The pastry support/server may be made in any of a variety of sizes, depending primarily on the height and diameter of the cakes or pies with which it will be used. A particularly versatile pastry support/server may be produced by making the height and width of the intermediate portion 3.5 inches and 4.00 inches, respectively, and making the long and short base edges of the trapezoidal flanges 2.75 and 1.5 inches, respectively. If the support server is to be used exclusively for pies, the height of the intermediate portion can be 2 inches instead of 3.5 inches. A thickness of 0.07 inch is a suitable thickness for the sheet material.

The principal advantages of the invention are that its symmetry makes it possible to use two identical support/servers on the two exposed faces of the remainder sector of a circular pastry article. Forming the flanges at acute angles, relative to the intermediate part provides improved support of the cake or pie, since the intermediate part then leans into the exposed face against which it is situated.

If the flanges are trapezoidal, still further improvement is realized in the ability of the support/server to prevent collapse of a pastry article, because the end of the shorter base of the flange extends past the serving portion, and fits underneath an adjacent part of the pastry article. The trapezoidal flanges also make the support/server useable with rectangular cakes and the like.

The transparency of the support/server, allows the exposed end of the pastry article to be seen, just as if no support were present.

Finally, the structure of the support/server is simple. It can be produced quickly and inexpensively by injection molding.

Various modifications can be made to the support/server as described above. For example, although polycarbonate is a preferred material, the support server can be produced from any of various other materials, provided they are approved for use with foods. The side edges of the intermediate portion should be straight and vertical in the preferred embodiment, but minor departures from the straight, vertical configuration will not adversely affect the performance of the support/server. It is also possible to produce a modified version of the support/server, in which the intermediate portion has a stepped configuration, and in which the flanges are of different lengths. This modified support/server can be used with pastry articles in a wider range of sizes. However, as it is not symmetrical, two different support/servers will ordinarily be supplied together. The shapes of the flanges can also be modified. For example, the flanges can have rounded corners.

Still other modifications may be made to the apparatus and method described above without departing from the scope of the invention as defined in the following claims.

The invention claimed is:

1. A combination pastry support and server comprising a substantially rigid, formed, sheet having a substantially planar intermediate portion adapted to engage a major part of the planar, radial, surface of one exposed end of a remainder sector of a circular article of pastry, said intermediate portion having first and second, parallel opposite edges, a first, substantially planar, flange, unitary with said intermediate portion, and extending transversely, relative to said intermediate portion, in a first direction from said first edge, and a second, substantially planar, flange, unitary with said intermediate portion, and extending in a second direction, opposite to said first direction, from said second edge, the included angle between each said flange and said intermediate portion being, at most, 90°, whereby said intermediate portion can be in face-to-face engagement with a planar, radial, surface of an exposed end of a remainder sector of a circular article of pastry, while one of said flanges is disposed underneath, and in facing engagement with, a bottom of said remainder sector, and said first and second flanges can be used interchangeably, respectively, as a handle, and as a support for lifting a serving portion of the pastry article, and in which each of said flanges has an outer edge oblique relative to said intermediate portion, whereby each flange is tapered.

2. A combination pastry support and server according to claim 1, in which the first and second substantially planar flanges are disposed in parallel planes.

3. A combination pastry support and server, comprising a substantially rigid, formed, sheet having an intermediate portion adapted to engage a major part of the surface of one exposed end of a remainder sector of a circular article of pastry, said intermediate portion having first and second, parallel opposite edges, a first flange, unitary with said intermediate portion, and extending transversely, relative to said intermediate portion, in a first direction from said first edge, and a second flange, unitary with said intermediate portion, and extending in a second direction, opposite to said first direction, from said second edge, whereby said first and second flanges can be used interchangeably, respectively, as a handle, and as a support for lifting a serving portion of the pastry article, in which each of the first and second flanges has opposite surfaces at least major portions of which are planar and parallel, and in which the planar major portions of the surfaces of both of the first and second flanges are parallel, and in which the intermediate portion also has parallel, planar, opposite surfaces, and in which the planar major portions of each of the flanges are disposed at an acute angle relative to said planar surfaces of the intermediate portion, and in which each of said flanges has an outer edge spaced from said intermediate portion, each outer edge having a first end and a second end, the distance from each said first end to said intermediate portion being greater than the distance from each said second end to said intermediate portion.

4. A combination pastry support and server according to claim 3, in which the planar major portions of each of the flanges are disposed at an angle of approximately 88 degrees relative to said planar surfaces of the intermediate portion.

5. A combination pastry support and server according to claim 1, in which the outer edge of each of said flanges is spaced from said intermediate portion, each said outer edge having a first end and a second end, the distance from each said first end to said intermediate portion being greater than the distance from each said second end to said intermediate portion.

6. A combination pastry support and server comprising a substantially rigid, formed, sheet having a substantially planar intermediate portion adapted to engage a major part of the planar, radial, surface of one exposed end of a remainder sector of a circular article of pastry, said intermediate portion having first and second, parallel opposite edges, a first, substantially planar, flange, unitary with said intermediate portion, and extending transversely, relative to said intermediate portion, in a first direction from said first edge, and a second, substantially planar, flange, unitary with said intermediate portion, and extending in a second direction, opposite to said first direction, from said second edge, the included angle between each said flange and said intermediate portion being, at most, 90°, whereby said intermediate portion can be in face-to-face engagement with a planar, radial, surface of an exposed end of a remainder sector of a circular article of pastry, while one of said flanges is disposed underneath, and in facing engagement with, a bottom of said remainder sector, and said first and second flanges can be used interchangeably, respectively, as a handle, and as a support for lifting a serving portion of the pastry article, in which each of said flanges has an outer edge spaced from said intermediate portion, said outer edge having a first end and a second end, the distance from said first end to said intermediate portion being greater than the distance from said second end to said intermediate portion, and in which the outer edge of each of said flanges is substantially straight and oblique relative to said intermediate portion, whereby each of said flanges has a trapezoidal shape.

7. A combination pastry support and server comprising a substantially rigid, formed, sheet having an intermediate portion adapted to engage a major part of the surface of one exposed end of a remainder sector of a circular article of pastry, said intermediate portion having first and second, parallel opposite edges, a first flange, unitary with said intermediate portion, and extending transversely, relative to said intermediate portion, in a first direction from said first edge, and a second flange, unitary with said intermediate portion, and extending in a second direction, opposite to said first direction, from said second edge, whereby said first and second flanges can be used interchangeably, respectively, as a handle, and as a support for lifting a serving portion of the pastry article, in which each of said flanges has an outer edge spaced from said intermediate portion, said outer edge having a first end and a second end, the distance from said first end to said intermediate portion being greater than the distance from said second end to said intermediate portion, in which each of said flanges has longer and shorter edges, both meeting and extending from said intermediate portion, and in which said longer edge of the first flange meets said intermediate portion at a location diagonally opposite a location at which said longer edge of the second flange meets said intermediate portion.

8. A combination pastry support and server according to claim 1 in which said sheet is optically transparent and composed of a polycarbonate resin.

9. A combination pastry support and server according to claim 5, in which each of said flanges has longer and shorter edges, both extending from said intermediate portion to its said outer edge, and in which at least said outer edge is beveled.

10. A combination pastry support and server according to claim 5, in which each of said flanges has longer and shorter edges, both extending from said intermediate portion to its said outer edge, and in which said outer edge of each flange, and at least a part of each of said longer and shorter edges extending from said outer edge, are beveled.

11. A combination pastry support and server comprising a substantially rigid, formed, sheet having a substantially planar intermediate portion adapted to engage a major part of the planar, radial, surface of one exposed end of a remainder sector of a circular article of pastry, said intermediate portion having first and second, parallel opposite edges, a first, substantially planar, flange, unitary with said intermediate portion, and extending transversely, relative to said intermediate portion, in a first direction from said first edge, and a second, substantially planar, flange, unitary with said intermediate portion, and extending in a second direction, opposite to said first direction, from said second edge, the included angle between each said flange and said intermediate portion being, at most, 90°, whereby said intermediate portion can be in face-to-face engagement with a planar, radial, surface of an exposed end of a remainder sector of a circular article of pastry while one of said flanges is disposed underneath, and in facing engagement with, a bottom of said article of pastry, and said first and second flanges can be used interchangeably, respectively, as a handle, and as a support for lifting a serving portion of the pastry article, in which each of said flanges has an outer edge oblique relative to said intermediate portion, whereby each flange is tapered, and in which said first and second flanges are tapered in opposite directions.

12. A combination pastry support and server according to claim 1, in which said intermediate portion is rectangular.

13. A combination pastry support and server comprising:

a substantially rigid, formed, sheet having an intermediate portion adapted to engage a major part of the surface of one exposed end of a remainder sector of a circular article of pastry, said intermediate portion having first and second, parallel opposite edges, a first flange, unitary with said intermediate portion, and extending transversely, relative to said intermediate portion, in a first direction from said first edge, and a second flange, unitary with said intermediate portion, and extending in a second direction, opposite to said first direction, from said second edge, whereby said first and second flanges can be used interchangeably, respectively, as a handle, and as a support for lifting a serving portion of the pastry article;

in which each of the first and second flanges has opposite surfaces at least major portions of which are planar and parallel, and in which the planar major portions of the surfaces of both of the first and second flanges are parallel;

in which the intermediate portion also has parallel, planar, opposite surfaces;

in which the planar major portions of each of the flanges are disposed at an acute angle relative to said planar surfaces of the intermediate portion; and in which each of said flanges has an outer edge spaced from said intermediate portion, said outer edge having a first end and a second end, the distance from said first end to said intermediate portion being greater than the distance from said second end to said intermediate portion.

14. A combination pastry support and server according to claim 13, in which each of said flanges has longer and shorter edges, both meeting and extending from said intermediate portion, and in which said longer edge of the first flange meets said intermediate portion at a location diagonally opposite a location at which said longer edge of the second flange meets said intermediate portion.

15. A combination pastry support and server comprising:

a substantially rigid, formed, sheet having an intermediate portion adapted to engage a major part of the surface of one exposed end of a remainder sector of a circular article of pastry, said intermediate portion having first and second, parallel opposite edges, a first flange, unitary with said intermediate portion, and extending transversely, relative to said intermediate portion, in a first direction from said first edge, and a second flange, unitary with said intermediate portion, and extending in a second direction, opposite to said first direction, from said second edge, whereby said first and second flanges can be used interchangeably, respectively, as a handle, and as a support for lifting a serving portion of the pastry article;

in which each of the first and second flanges has opposite surfaces at least major portions of which are planar and parallel, and in which the planar major portions of the surfaces of both of the first and second flanges are parallel;

in which the intermediate portion also has parallel, planar, opposite surfaces;

in which the planar major portions of each of the flanges are disposed at an acute angle relative to said planar surfaces of the intermediate portion;

in which each of said flanges has an outer edge oblique relative to said intermediate portion, whereby each flange is tapered; and in which said first and second flanges are tapered in opposite directions.

16. A combination pastry support and server according to claim 1, in which said first and second flanges are tapered in opposite directions.

* * * * *